US005933695A

United States Patent [19]

Henry et al.

[11] Patent Number: 5,933,695

[45] Date of Patent: Aug. 3, 1999

[54] RAPID WAKE UP FUSER SYSTEM MEMBERS WITH SILICONE LAYER

[75] Inventors: Arnold W. Henry, Pittsford; George J. Heeks; David J. Gervasi, both of Rochester, all of N.Y.

[73] Assignee: Xerox Corporation, Stamford, Conn.

[21] Appl. No.: 09/127,949

[22] Filed: Aug. 3, 1998

[51] Int. Cl.[6] ..... G03G 15/20

[52] U.S. Cl. ..... 399/333; 399/335; 492/53

[58] Field of Search ..... 399/333, 328, 399/330, 335, 336; 492/53, 56; 219/216; 430/124; 428/906

[56] References Cited

U.S. PATENT DOCUMENTS

| | | | |
|---|---|---|---|
| 5,166,031 | 11/1992 | Badesha et al. | 430/124 |
| 5,281,506 | 1/1994 | Badesha et al. | 430/124 |
| 5,360,833 | 11/1994 | Eckberg et al. | 522/31 |
| 5,366,772 | 11/1994 | Badesha et al. | 428/35.8 |
| 5,369,205 | 11/1994 | Eckberg et al. | 528/25 |
| 5,370,931 | 12/1994 | Fratangelo et al. | 428/334 |
| 5,602,635 | 2/1997 | Domoto et al. | 399/328 |
| 5,650,453 | 7/1997 | Eckberg et al. | 522/31 |
| 5,765,085 | 6/1998 | Law et al. | 399/329 |
| 5,774,763 | 6/1998 | Muramatsu | 399/328 X |
| 5,774,776 | 6/1998 | Takada et al. | 399/328 |
| 5,778,295 | 7/1998 | Chen et al. | 399/329 |

*Primary Examiner*—Richard Moses
*Attorney, Agent, or Firm*—Annette L. Bade

[57] ABSTRACT

An rapid wake up fuser system member for use in an electrophotographic apparatus for fusing toner images to a copy substrate, the fuser member having a substrate, a heat transmissive layer having a silicone material and a Q-resin provided on the substrate layer, and a polymer-containing toner release layer provided on the heat transmissive layer.

27 Claims, 3 Drawing Sheets

RAPID WAKE UP FUSER SYSTEM MEMBERS WITH SILICONE LAYER

BACKGROUND OF THE INVENTION

The present invention relates to rapid wake up fuser systems, and more specifically, to silicone materials useful as layers for rapid wake up fuser systems in electrostatographic, including digital, systems. In embodiments, the layers provide for the warming up period for the fuser member to be significantly decreased, and the power consumption of the fuser member to be decreased, while allowing for high operating temperature and mechanical strength. Also, in embodiments, the layers permit a decrease in contamination of other xerographic components such as photoconductors. In addition, in embodiments, the layers have a low surface energy and the conformity of the layers is not adversely affected.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

Most current fusers use conduction as the main heat transfer mechanism to melt toner to paper. Such systems suffer from non-uniform axial temperature distributions when various paper widths are fed through the fusing nip. Some of these problems are addressed through shaping of the heat lamp axial profile or by using multiple heat lamps to allow control of the axial heating profile.

Because axial heat transfer is controlled by conduction, most fusers have difficulty with transport of energy in the axial direction. Invariably, this leads to overheating of the rubber layers which is a major cause for reduced fuser life.

Known heat fixing apparatuses also demonstrate problems due to the lengthy warm up time required before the heating body is raised to a specified temperature. In some machines, the fuser member is in heated mode 90 to 100 percent of the time the machine is turned on. Because the fuser is heated at all times, there is an increased chance of overheating, and mechanical problems resulting from the fuser member overheating or breaking down from overuse.

Moreover, with the fuser member continuously being heated, much energy is wasted. The Environmental Protection Agency has proposed new "energy star" guidelines for printers and copiers. Current fusers that operate in a continuous heat mode may not meet the expectations of a "green machine."

A preferred fusing system for copying and printing is the use of a "rapid wake up" fuser system, wherein the image on a copy substrate is fused by positioning the paper through a nip between a fuser roll and a pressure roll, the fuser roll and/or pressure roll comprising a substrate, a heat transmissive layer and a toner releasing layer (or heat transporting layer). The fuser converts electric energy directly to thermal energy, and is therefore more energy efficient. The rapid wake up fuser member is advantageous in that the warming up period is reduced as the heater is quick to respond. In addition, the rapid wake up fuser member allows for a reduction in energy consumption because the heater is off when the machine is not copying.

Rapid wake up fusing systems as set forth above are well known and disclosed in, for example, U.S. Pat. No. 5,602,635, to Domoto et al., the disclosure of which is hereby incorporated by reference in its entirety. This reference discloses an rapid wake up fusing system including a heated transparent fusing member, the fusing member heated so that the heat energy is focused in a relatively narrow area adjacent the nip, and a heat leveling member in contact with the fusing member, wherein the heat leveling member is adapted to transfer heat along a longitudinal axis of the fusing member so as to equalize the temperature therealong. This fuser member provides a very uniform fusing temperature along its axis and a high efficiency for fusing images to a copy substrate.

Radiant fusers can be rapid turn on because the energy from the lamp is deposited directly into the toner layer raising its temperature to that required for fusing to the paper. However, because the heat is raised to such a high level in a shorter period of time, offset of the toner particles from the support to the fuser member take place during operations. Toner particles offset onto the fuser member may subsequently transfer to other parts of the machine or onto the support in subsequent copying cycles, thus increasing the background or interfering with the material being copied there.

Therefore, there exists a specific need for a fusing system member which is quick to heat up, and which allows for decreased use of energy. In addition, there exists a need for a fuser member in which the conformability, a low surface energy and mechanical properties of the release layer are not affected by the configuration of the layers. There further exists a need for a fusing system which provides for good release properties and a decrease in the occurrence of hot offset.

SUMMARY OF THE INVENTION

The present invention relates to, in embodiments: a fuser member comprising: a) a substrate; b) a heat transmissive layer provided on the substrate, the heat transmissive layer comprising a silicone material and a Q resin and c) a toner release layer comprising a polymer, and provided on the heat transmissive layer.

In addition, embodiments include: a fuser member having the ability to warm up from a temperature of about 24° C. to a temperature of up to about 200° C. in a time of less than about 1 minute comprising: a) a substrate; b) a heat transmissive layer provided on the substrate, the heat transmissive layer comprising a silicone material and a Q-resin and; c) a toner release layer comprising a polymer, and provided on the heat transmissive layer.

Moreover, embodiments include: an image forming apparatus for forming images on a recording medium comprising: a charge-retentive surface to receive an electrostatic latent image thereon; a development component to apply toner to the charge-retentive surface to develop the electrostatic latent image to form a developed image on the charge retentive surface; a transfer component to transfer the developed image from the charge retentive surface to a copy substrate; and a fuser member for fusing toner images to a surface of the copy substrate, wherein the fuser member comprises: a) a substrate; b) a heat transmissive layer provided on the substrate, the heat transmissive layer comprising a silicone material and a Q-resin and; c) a toner release layer comprising a polymer, and provided on the heat transmissive layer.

BRIEF DESCRIPTION OF THE DRAWINGS

For a better understanding of the present invention, reference may be had to the accompanying drawings.

DETAILED DESCRIPTION OF THE PRESENT INVENTION

The present invention relates to fuser systems comprising fuser members, which herein relates to, in embodiments, a fuser member, donor member or pressure member, having a substrate, and having thereon, a heat transmissive layer, and having on the outer surface thereof a toner releasing layer. A pressing member is used in connection with the fusing member and the copy substrate having toner thereon is brought into contact with the nip formed between the pressure member and the fuser member. Generally, the construction of the rapid wake up fuser is well known as set forth in Domoto et al., U.S. Pat. No. 5,602,635, discussed in the background above. Domoto et al. teaches a fuser member comprising a glass (PYREX®) or quartz substrate, a transparent low conductivity silicone rubber layer for conformability, and a TEFLON® or VITON® coating.

The term "fuser member" includes members of the fusing system in an electrostatographic, including digital, apparatus, including fuser rolls, belts, films and the like; pressure rolls, belts, films, and the like; and donor rolls, belts, films, and the like.

The rapid warm up fuser works as a radiant fuser member. The heat energy is focused in a relatively narrow area adjacent the nip. The substrate is preferably transparent to allow for infrared transmission of heat from the substrate to the outer release layer of the fuser member. The rapid warm up IS fuser member preferably has a about 0.2 of a second warm-up and exhibits little or no temperature droop or warm up time, which is characteristic of conventional roll fusers. The underlying idea is to use a fuser core which is transparent to the lamp radiation and to focus lamp radiation to a narrow beam within the nip and at or near the interface between the fuser member and the copy substrate. This will cause heating of the outer layer at the nip. As the roller heats up, more of the energy will be deposited into the toner, less into the roller, requiring less heat from the lamp. Further, the focus of the beam within the nip helps prevent the possibility of igniting paper. It is preferable that the underlayer or intermediate layer is less thermally conductive than the outer release layer, so that the tendency is for the heat to remain on the outer layer and not to dissipate back towards the center of the member. This superior configuration is established by the layers chosen for the fuser member set forth in the present invention.

Figure 1:
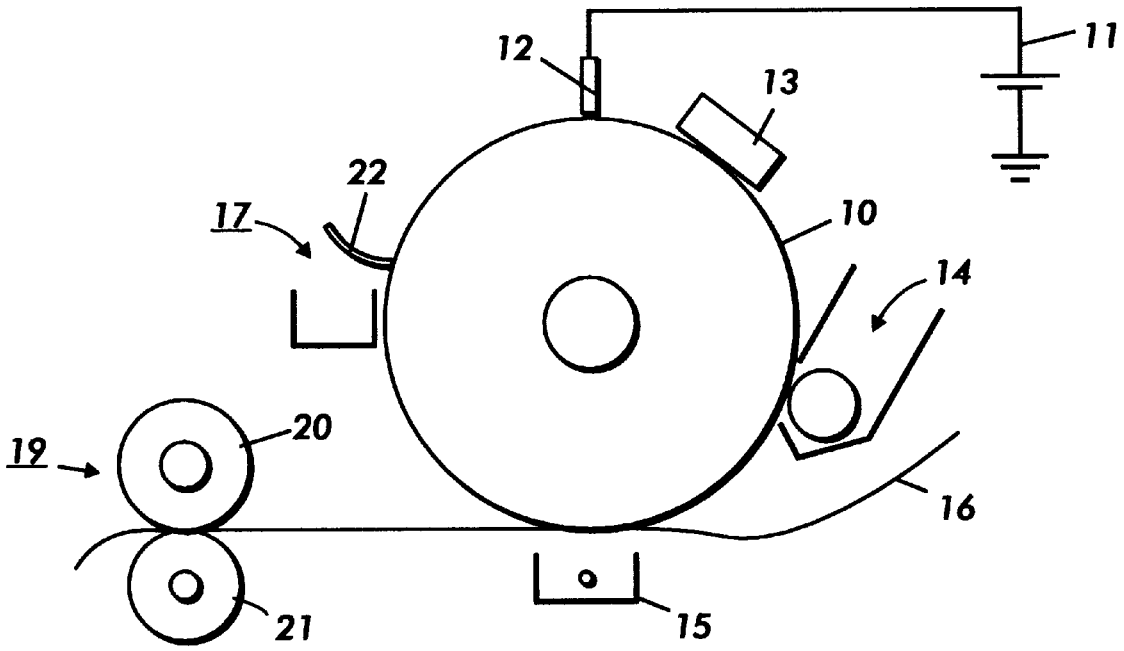
FIG. 1 demonstrates an example of an electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger to which a voltage has been supplied from power supply. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
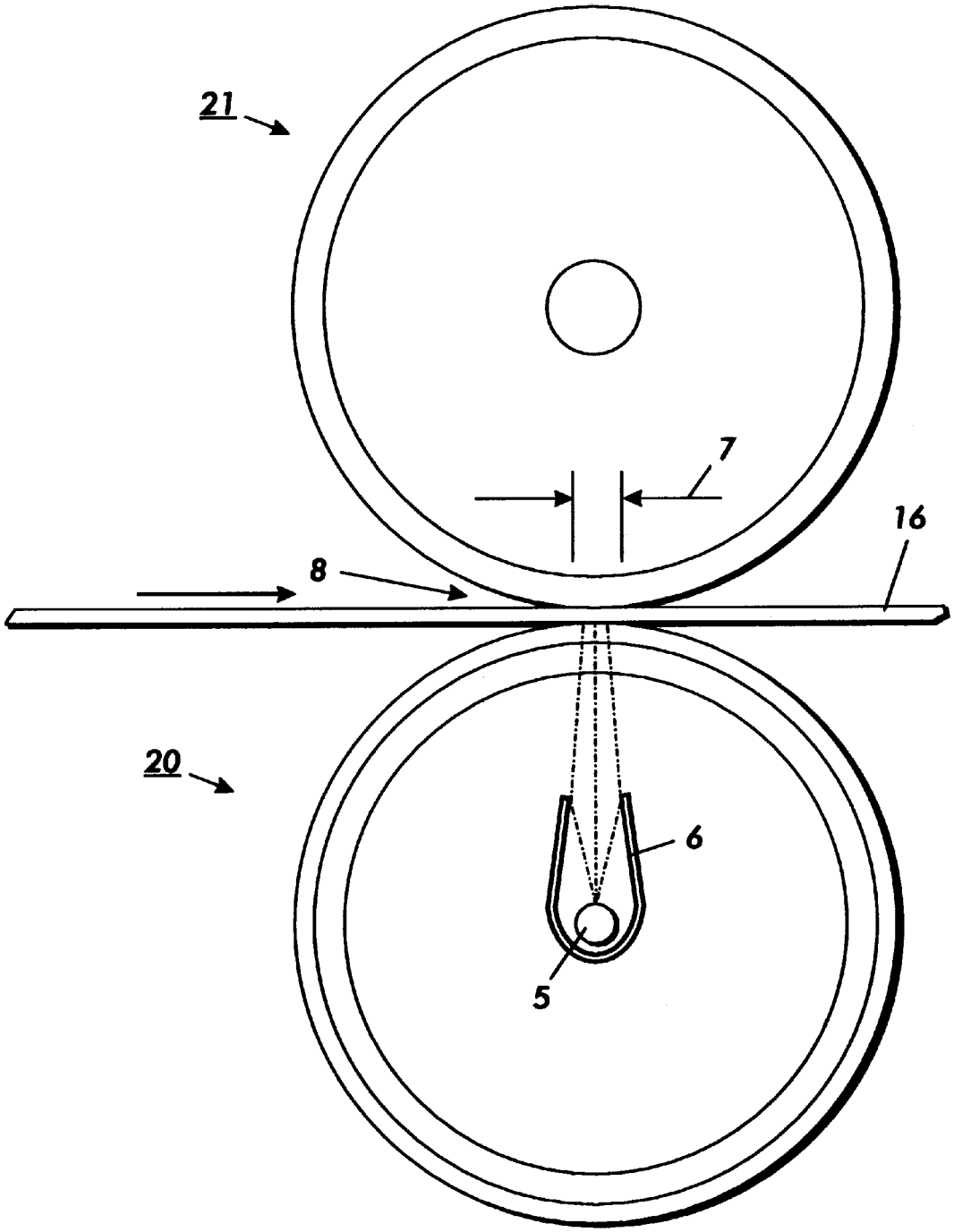
FIG. 2 is an illustration of an rapid wake up fuser member described herein.

Referring to FIG. 2, a basic configuration of an embodiment of the invention is illustrated including a transparent fuser roller 20, and pressure roller 21. Heat lamp 6 is included within the fuser roller 20, and elliptic focusing reflector 5 which focuses the heat from the heat lamp to the defined heating area 7 of the transparent fuser roller 20 is set forth. There is shown a fractional loss of heat corresponding to the portion of the ellipse which must be cut away to clear the roll. The pressure roller 21 is adjacent the transparent fuser roller 20 and forms a nip 8 therebetween which the copy substrate 16 with the unfused toner passes through.

Figure 3:
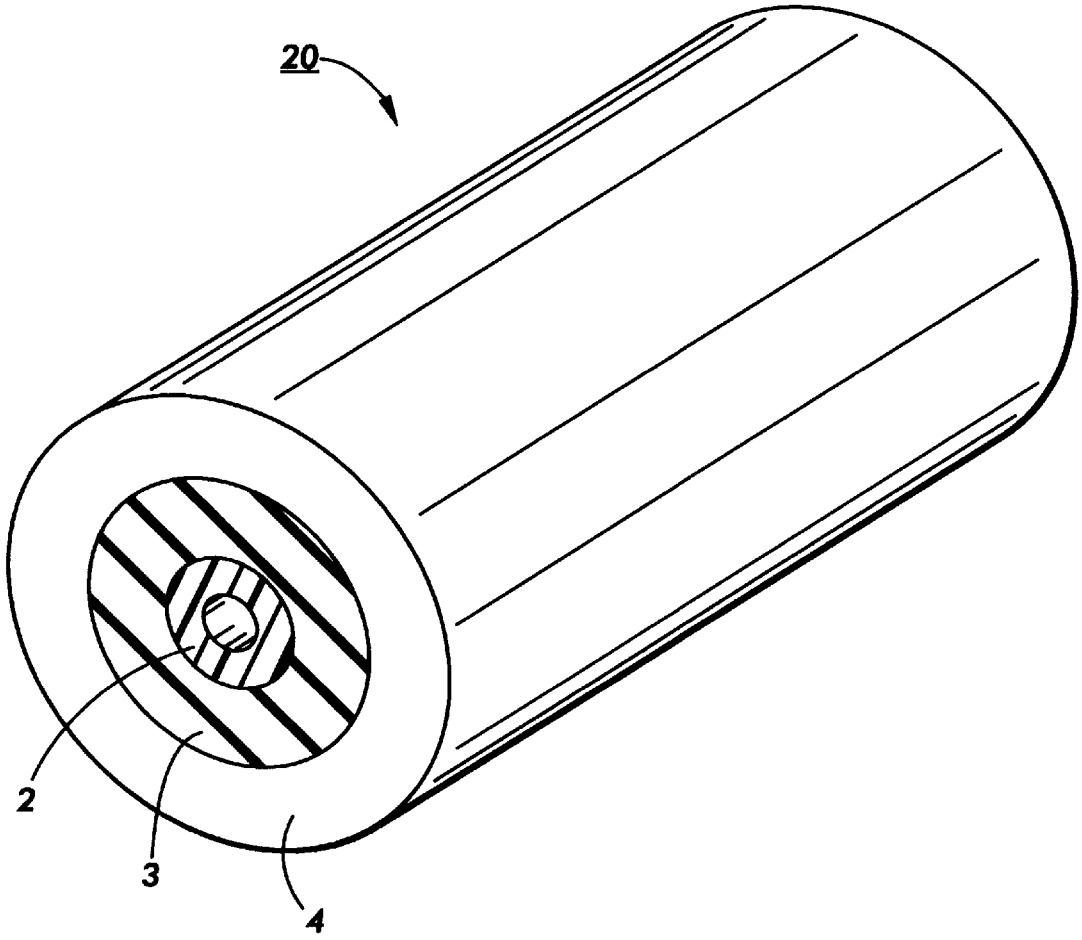
FIG. 3 demonstrates a preferred embodiment of a fuser member described herein.

Referring to FIG. 3, there is shown by way of example, a preferred fuser member 20 of the present invention. The fuser member comprises a substrate 2 and thereover a heat transmissive layer 3, and thereover as the outer layer of the fuser member, a toner releasing layer (or heat transporting layer) 4. Optional additional intermediate layers and/or adhesive layers may be present between the substrate 2 and the heat transmissive layer 3 and/or between the heat transmissive layer 3 and the outer toner releasing layer 4.

The fuser system members herein contain heat transmissive layers comprising silicone materials. In a preferred embodiment, a Q-resin is added to the silicone material to act as a reinforcing agent that may crosslink with the silicone material making it more stable and increasing the strength thereof.

Examples of suitable silicone materials include room temperature vulcanization (RTV) silicone rubbers and low temperature vulcanization (LTV) silicone rubbers. These rubbers are known and readily available commercially such as SYLGARD® 182 from Dow Corning and RTV615 Silicone Rubber from General Electric Silicones. Other suitable silicone materials include the silanes, siloxanes (preferably polydimethylsiloxanes) such as, fluorosilicones, dimethylsilicones, liquid silicone rubbers such as vinyl crosslinked or silanol room temperature crosslinked materials, and the like.

The term "Q-resin" as used herein refers to a siloxane gel-like structure containing functionalized silicone groups dispersed within a polydimethylsiloxane fluid. The Q-resin can be obtained in the viscosity range of 4,000–70,000 cps with molecular weight ranging from about 70,000 to about 200,000. In a preferred embodiment, the functionalized silicone groups comprise vinyl groups.

The Q-resin reacts with the silicone material and thereby crosslinks with the silicone material. The Q-resin acts as a reinforcing agent and crosslinking agent. A generic Q-resin structure is set forth as the following Formula I:

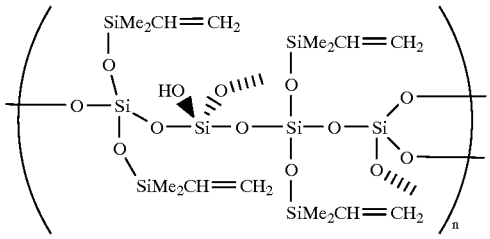

wherein n represents a number and is from about 100 to about 325, preferably from about 200 to about 300. Reference the United Chemical Technologies, Inc. (UCT) Technical Support. A commercially available vinyl-containing Q-Resin Fluid is available from UCT.

Preferably, the Q-resin is present in the heat transmissive layer in an amount of from about 5 to about 50 weight percent, and preferably from about 10 to about 30 weight percent by weight of total solids. The silicone material is preferably present in the heat transmissive layer in an amount of from about 95 to about 50 weight percent, and preferably from about 90 to about 70 weight percent by weight of total solids.

Preferably, the heat transmissive layer is a conformable layer having a relatively high thickness. The thickness of the heat transmissive layer is from about 3 to about 12.5, and preferably from about 6 to about 8 millimeters.

In a preferred embodiment, the heat transmissive layer does not include any fillers.

Present on the heat transmissive layer is an outer toner releasing layer comprising a polymer, and preferably a fluoropolymer. Examples of suitable fluoropolymers include the TEFLON®-type materials such as those comprising the following monomers polytetrafluoroethylene (PTFE), fluorinated ethylenepropylene (FEP), perfluoroalkoxy (PFA), perfluorovinylalkylether tetrafluoroethylene copolymer (PFA TEFLON®), polyethersulfone, copolymers thereof, terpolymers thereof, and the like.

In addition, suitable fluoropolymers include fluoroelastomers particularly from the class of copolymers, terpolymers and tetrapolymers of vinylidenefluoride, hexafluoropropylene and tetrafluoroethylene, and an optional cure site monomer are known commercially under various designations as VITON A®, VITON E®, VITON E60®, VITON E430, VITON 910®, VITON GH®, VITON B50®, VITON E45®, and VITON GF®. The VITON® designation is a Trademark of E.I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II®(LII900) a poly (propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company.

Preferred fluoroelastomers are those which contain hexafluoropropylene and tetrafluoroethylene as comonomers. Two preferred known fluoroelastomers are (1) a class of copolymers of vinylidenefluoride and hexafluoropropylene known commercially as VITON A® and (2) a class of terpolymers of vinylidenefluoride, hexafluoropropylene and tetrafluoroethylene known commercially as VITON B®.

In another preferred embodiment, the fluoroelastomer is one having a relatively low quantity of vinylidenefluoride, such as in VITON GF®. The VITON GF® is a tetrapolymer comprising about 35 weight percent of vinylidenefluoride, about 34 weight percent of hexafluoropropylene, about 29 weight percent of tetrafluoroethylene with 2 percent weight site monomer. Examples of cure site monomers include 4-bromoperfluorobutene-1, 1,1-dihydro-4-bromoperfluorobutene-1, 3-bromoperfluoropropene-1, 1,1-dihydro-3-bromoperfluoropropene-1, and commercially available cure site monomers available from, for example, DuPont.

Examples of fluoroelastomers suitable for use herein for the toner releasing layers include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer.

In embodiments, the polyorganosiloxane having functionality according to the present invention has the formula:

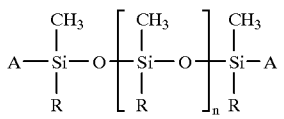

where R is an alkyl from about 1 to about 24 carbons, or an alkenyl of from about 2 to about 24 carbons, or a substituted or unsubstituted aryl of from about 6 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

In a preferred embodiment, a filler is included in the toner release layer. Examples of suitable conductive fillers include carbon black, graphite and the like; metal fibers and metal powder particles such as silver, nickel, aluminum, and the like; metal oxides such as copper oxide, aluminum oxide, magnesium oxide, tin oxide, titanium oxide, iron oxide, zinc oxide and the like, and mixtures thereof; along with other known conductive ceramic powders and mixtures of any of the above fillers. These additives may be present in the toner releasing layer in an amount of from about 3 to about 40 percent by weight of total solids, and preferably from about 5 to about 30 percent by weight.

The thickness of the toner releasing layer is from about 10 to about 60, and preferably from about 25 to about 40 $\mu$m.

The substrate for the rapid wake up fuser member can be of any suitable configuration including a sheet, belt, film or roller. In a preferred embodiment, the substrate comprises quartz or glass. Examples of commercially available substrates include PYREX®, made by Corning Glass, Inc. and a quartz tube made from General Electric or F. J. Gray of Jamaica, N.Y.

The use of quartz or glass cores as set forth above in fuser members herein allows for a light weight, low cost fuser system member to be produced. Moreover, the glass and quartz helps allow for quick warm-up and are therefore, more energy efficient than other known fuser member. In addition, because the core of the fuser member is comprised of glass or quartz, there is a real possibility that such fuser members can be recycled. Moreover, these cores allow for high thermal efficiency by providing superior insulation.

Optional intermediate adhesive or layers and/or elastomer layers may be applied to achieve desired properties and performance objectives of the present conductive film. An adhesive intermediate layer may be selected from, for example, silanes. Preferred adhesives are materials such as Dow Corning P5200, Dow Corning S-2260, Union Carbide A-1100, and United Chemical Technologies A0728.

There may be provided an adhesive or other layer between the substrate and the heat transmissive layer. There may also be an adhesive or other layer between the heat transmissive layer and the toner releasing layer.

The heat transmissive layer of the rapid wake up fuser member is deposited on the substrate via a well known web low pressure molding or spin casting process. Other known methods for forming the outer layer on the substrate such as spinning, dipping, flow coating, spraying such as by multiple spray applications of very thin films, casting, or the like can also be used. The toner releasing layer may be deposited on the heat transmissive layer in a similar manner as the heat transmissive layer is deposited on the substrate.

The substrate preferably has a diameter of from about 0.2 to about 3 inches. The thickness of the substrate will depend on the mechanical property of the material used but is preferably from about 6 to about 12 mm thick. The substrate in the form of a cylindrical roll may be from about 3 to about 20 inches, preferably from about 12 to about 18 inches long.

The fuser system members of the present invention allow for relatively fast warm up time. The fast warm-up time for the fusing system members of the present invention is from about 1 second up to from less than about 1 minute, preferably from about 1 second to up to less than about 30 seconds, and particularly preferred from about 1 second up to less than about 10 seconds. This is the amount of time it takes for the fuser member to heat up from room temperature (24° C.) to a temperature of approximately 200° C. This allows the fuser to be in an off mode when the particular machine is not being used which, in turn, allows for a significant reduction in energy consumption.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

A hollow quartz substrate having the dimensions of about 14 inches long, about 3 inches in diameter, and about 0.25 inches thick, was overcoated with a clear, fillerless energy transmissive silicone layer. The silicone layer used was Dow Corning SYLGARD®182 (also GE Silicones GE RTV615), which is a Q-Resin containing silicone material. The Q-Resin is present in a range of from about 5 to about 50 percent by weight, with a preferred range of from about 10 to about 30 percent by weight of total solids. The silicone layer was formed by low compression molding. The fuser roller was heat cured at a temperature of about 300° F. for a time of about 15 minutes. An amount of about 5 pph carbon black N-990 was added to an amount of about 100 pph VITON GF® obtained from DuPont. The VITON® and carbon black were two roll milled, solvent dispersed, and then spray coated on the silicone layer to a thickness of approximately 15 microns. The overcoated roller was step-cured at a temperature of about 120° F. for about 4 hours, about 200° F. for about 2 hours, about 300° F. for about 2 hours, about 350° F. for about 2 hours, about 400° F. for about 2 hours, and about 450° F. for about 12 hours.

A non-focused energy source was placed within the quartz core. The energy source was plugged into an outlet and the temperature of the outer VITON®/carbon black layer of the rapid wake up fuser member was measured. It was determined that the outer layer went from a temperature of about room temperature (about 25° C.) to about 200° C. in about 6 seconds.

This result demonstrated that the rapid wake up fuser member having a substrate, a heat transmissive layer comprising a silicone material and a Q-resin, and a toner release layer comprising a polymer provides a rapid wake up fuser member with superior ability to heat up to fusing temperature in a limited amount of time, thereby increasing fusing speed and reducing energy consumption.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims. Unless otherwise indicated, all percentages set forth in the specification are percentages by weight of total solids.

We claim:

1. A fuser member comprising:

a) a substrate;

b) a heat transmissive layer provided on said substrate, said heat transmissive layer comprising a silicone material and a Q-resin, and;

c) a toner release layer comprising a polymer, and provided on said heat transmissive layer.

2. A fuser member in accordance with claim 1, wherein said Q-resin comprises a siloxane compound having functionalized silicone end groups.

3. A fuser member in accordance with claim 2, wherein said functionlized silicone end groups comprise vinyl groups.

4. A fuser member in accordance with claim 1, wherein said Q-resin has the following Formula I:

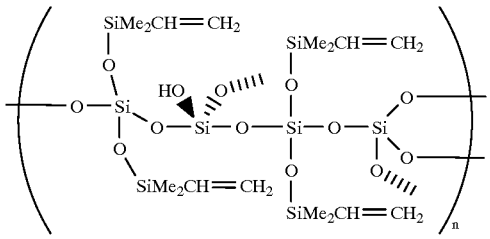

wherein n represents a number and is from about 100 to about 325.

5. A fuser member in accordance with claim 1, wherein said silicone material is selected from the group consisting of room temperature vulcanization silicone rubbers and low temperature vulcanization silicone rubbers.

6. A fuser member in accordance with claim 1, wherein said silicone material is selected from the group consisting of silanes, siloxanes, fluorosilicones, and dimethylsilicones.

7. A fuser member in accordance with claim 1, wherein said Q-resin is present in the heat transmissive layer in an amount of from about 5 to about 50 weight percent by weight of total solids.

8. A fuser member in accordance with claim 7, wherein said Q-resin is present in the heat transmissive layer in an amount of from about 10 to about 30 weight percent by weight of total solids.

9. A fuser member in accordance with claim 1, wherein said toner release layer polymer is a fluoropolymer.

10. A fuser member in accordance with claim 9, wherein the fluoropolymer is selected from the group consisting of polytetrafluoroethylene, fluorinated ethylenepropylene copolymer, and polyfluoroalkoxypolytetrafluoroethylene.

11. A fuser member in accordance with claim 9, wherein the toner release layer polymer is a volume grafted fluoroelastomer.

12. A fuser member in accordance with claim 9, wherein the fluoropolymer is selected from the group consisting of a) copolymers of vinylidenefluoride, hexafluoropropylene, and tetrafluoroethylene; b) terpolymers of vinylidenefluoride, hexafluoropropylene and tetrafluoroethylene; and c) tetrapolymers of vinylidenefluoride, hexafluoropropylene, tetrafluoroethylene; and a cure site monomer.

13. A fuser member in accordance with claim 12, wherein the fluoropolymer comprises about 35 weight percent of vinylidenefluoride, about 34 weight percent of hexafluoropropylene, about 29 weight percent of tetrafluoroethylene and about 2 weight percent of a cure site monomer.

14. A fuser member in accordance with claim 1, wherein said toner releasing layer comprises a filler selected from the group consisting of metal oxides, graphite, carbon black and mixtures thereof.

15. A fuser member in accordance with claim 14, wherein the filler is present in the toner releasing layer in an amount of from about 3 to about 40 percent by weight of total solids.

16. A fuser member in accordance with claim 14, wherein said filler is carbon black.

17. A fuser member in accordance with claim 14, wherein said filler is a metal oxide selected from the group consisting of zinc oxide, iron oxide, aluminum oxide, copper oxide, and mixtures thereof.

18. A fuser member in accordance with claim 1, wherein said heat transmissive layer has a thickness of from about 3 to about 12.5 millimeters.

19. A fuser member in accordance with claim 1, wherein said toner releasing layer has a thickness of from about 10 to about 60 $\mu$m.

20. A fuser member in accordance with claim 1, wherein said substrate is a hollow cylindrical roll.

21. A fuser member in accordance with claim 1, wherein said substrate comprises a material selected from the group consisting of quartz and glass.

22. A fuser member in accordance with claim 1, wherein said substrate is in the form of a belt.

23. A fuser member in accordance with claim 1, wherein said fuser member has the ability to warm up from a temperature of about 24° C. to a temperature of up to about 200° C. in a time of less than about 1 minute.

24. A fuser member in accordance with claim 23, wherein said warm up time is less than about 30 seconds.

25. A fuser member in accordance with claim 24, wherein said warm up time is less than about 10 seconds.

26. A fuser member having the ability to warm up from a temperature of about 24° C. to a temperature of up to about 200° C. in a time of less than about 1 minute comprising:

a) a substrate;

b) a heat transmissive layer provided on said substrate, said heat transmissive layer comprising a silicone material and a Q-resin and;

c) a toner release layer comprising a polymer, and provided on said heat transmissive layer.

27. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fuser member for fusing toner images to a surface of said copy substrate, wherein said fuser member comprises:

a) a substrate;

b) a heat transmissive layer provided on said substrate, said heat transmissive layer comprising a silicone material and a Q-resin and;

c) a toner release layer comprising a polymer, and provided on said heat transmissive layer.

* * * * *